US008696834B2

(12) United States Patent
Kondo et al.

(10) Patent No.: US 8,696,834 B2
(45) Date of Patent: Apr. 15, 2014

(54) METHOD FOR MANUFACTURING SEAMLESS PIPES

(75) Inventors: Keiichi Kondo, Wakayama (JP); Toshiharu Abe, Osaka (JP); Kunio Kondo, Sanda (JP); Yuichi Yano, Wakayama (JP); Yuji Arai, Amagasaki (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 27 days.

(21) Appl. No.: 13/236,702

(22) Filed: Sep. 20, 2011

(65) Prior Publication Data

US 2012/0042992 A1 Feb. 23, 2012

Related U.S. Application Data

(63) Continuation of application No. PCT/JP2010/055713, filed on Mar. 30, 2010.

(30) Foreign Application Priority Data

Mar. 30, 2009 (JP) ..... 2009-082700

(51) Int. Cl.

| | |
|---|---|
| ***C21D 9/08*** | (2006.01) |
| ***C22C 38/22*** | (2006.01) |
| ***C21D 11/00*** | (2006.01) |

(52) U.S. Cl.
USPC ..... 148/593; 148/334; 148/504

(58) Field of Classification Search
USPC ..... 148/333, 334, 504, 593; 420/103–105, 420/110, 123, 124, 126
See application file for complete search history.

(56) References Cited

U.S. PATENT DOCUMENTS 5,938,865 A * 8/1999 Kondo et al. ..... 148/593

FOREIGN PATENT DOCUMENTS

| | | |
|---|---|---|
| CN | 100587083 | 2/2010 |
| JP | 59-232220 | 12/1984 |
| JP | 62-120430 | 6/1987 |
| JP | 63-054765 | 10/1988 |
| JP | 05-024201 | 4/1993 |
| JP | 06-220536 | 8/1994 |
| JP | 08-311551 | 11/1996 |
| JP | 09-287028 | 11/1997 |
| JP | 10-280037 | 10/1998 |
| JP | 2000-017389 | 1/2000 |
| JP | 2000-297344 | 10/2000 |
| JP | 3362565 | 1/2003 |
| JP | 2007-031756 | 2/2007 |
| WO | 2008/123422 | 10/2008 |

* cited by examiner

*Primary Examiner* — Roy King
*Assistant Examiner* — Caitlin Kiechle
(74) *Attorney, Agent, or Firm* — Clark & Brody

(57) ABSTRACT

A method for suppressing shock and storage cracking when manufacturing seamless steel pipes comprises hot piercing and hot rolling a billet consisting of, by mass percent controlled amounts of C, Si, Mn, Cr, Mo, Ti, and Al, with the balance being Fe and impurities of Ni, P, S, N, and O also in controlled amounts. Further heat treatment is performed, wherein a hot rolled steel pipe is direct quenched from a temperature of not lower than the $Ar_3$ transformation point and the pipe is then subjected to heat treatment at a temperature of not lower than 450° C. and not higher than the $Ac_1$ transformation point in heat treatment equipment for performing direct quenching. The steel pipe subjected to the heat treatment is reheated, quenched from a temperature of not lower than the $Ac_3$ transformation point, and tempered at a temperature of not higher than the $Ac_1$ transformation point.

2 Claims, 2 Drawing Sheets

METHOD FOR MANUFACTURING SEAMLESS PIPES

TECHNICAL FIELD

The present invention relates to a method for manufacturing low-alloy seamless steel pipes. More particularly, it relates to a method for manufacturing low-alloy seamless steel pipes having excellent toughness in direct quenching or inline heat treatment, and also to a method thereof capable of preventing delayed fracture in the manufacturing process. The term "inline heat treatment" refers to a process comprising: (a) complementary heating hot-rolled steel pipes in a complementary soaking furnace at a temperature higher than the $Ar_3$ point without step for cooling after hot-rolling; and (b) then quenching the pipes immediately after taking out of the complementary soaking furnace. Hereinafter, the term "inline heat treatment step" refers to the step for complementarily heating and then quenching, the term "inline heat treatment method" refers to the method thereof, and the term "inline quenching" refers to the quenching conducted in the inline heat treatment step.

BACKGROUND ART

From the viewpoint of reliability, seamless steel pipes are widely used mainly in applications such as oil country tubular goods (OCTG), line pipes, and the like that are required to have high corrosion resistance and toughness. Seamless steel pipes made of various kinds of low-alloy steels are used in these applications. In manufacturing the seamless steel pipes, in order to increase the strength properties and toughness, the steel pipes are often subjected to heat treatment of hot rolled pipes such as quenching and tempering. As a method for heat treatment such as quenching and tempering, a conventional reheating and quenching process has been practiced, wherein the hot rolled pipes are once cooled and then reheated to the $Ac_3$ transformation point or a higher temperature in an offline heat treatment furnace followed by quenching, and thereafter tempered at a temperature not higher than the $Ac_1$ transformation point. At the same time, however, from the viewpoint of saving process steps and energy, a direct quenching process has been investigated and improved, wherein the as-rolled hot pipes are immediately direct quenched from the $Ar_3$ transformation point or a higher temperature that is based on a potential heat of the as-rolled hot pipes, and then tempered.

Patent Document 1 has disclosed a method for manufacturing high-strength steel pipes excellent in sulfide stress-corrosion cracking resistance, comprising steps of working continuously cast billets of a low-alloy steel having a specific composition into seamless steel pipes at a temperature not lower than the $Ac_3$ transformation point, direct quenching the steel pipes, reheating the steel pipes to the temperature range from the $Ac_3$ transformation point to a temperature of the $Ac_3$ transformation point+100° C., and quenching the steel pipes again from this temperature, and a step of tempering the steel pipes at a temperature not higher than the $Ac_1$ transformation point. This is a method in which reheating and quenching are added before the tempering step of simple direct quenching process. With this method, the sulfide stress-corrosion cracking resistance is improved significantly by a grain refinement as compared with the simple direct quenching process.

Patent Document 2 has, similarly to Patent Document 1, disclosed a method for manufacturing high-strength steel pipes that comprises a step of performing reheating and quenching after direct quenching, wherein the steel pipes are direct quenched and tempered under specific conditions to control precipitated carbides.

Patent Document 3 has disclosed a method for manufacturing high-strength seamless steel pipes excellent in sulfide stress cracking resistance (hereinafter, referred to as "SSC resistance") in which billets of a low-alloy steel having a specific composition are hot pierced and hot rolled to produce seamless steel pipes. In this method, the billets are pierced and then finish rolled at a reduction of area of 40% or more at the finishing temperature of 800 to 1050° C., thereafter being subjected to "reheating" under specific conditions in the temperature range of 850 to 1100° C., and then the steel pipes are immediately subjected to "direct quenching", and are tempered at a temperature not higher than the $Ac_1$ transformation point. This Document also describes a method in which reheating and quenching are performed once or twice after the "direct quenching."

The term "reheating" described in claim 1 of Patent Document 3 refers to not a reheating from the normal temperature, but refers to a reheating performed on the way from the finish rolling step to the direct quenching step, and therefore corresponds to the "complementary heating" in this description. Patent Document 3 describes that this "reheating" contributes to making crystal grains fine as recrystallizing treatment. The term "direct quenching" is used in Patent document 3, and the process of the "direct quenching" and the precedent process correspond to the inline heat treatment in this description. That is, Patent Document 3 relates to a technique of improved inline heat treatment method, or a technique in which the reheating and quenching are combined with inline heat treatment step.

Patent Document 4 also has disclosed a method for manufacturing seamless steel pipes. In this method, after piercing-rolling has been performed at a specific strain rate, the pipes are rolled at a specific average strain rate, at a working ratio of 40% or more, and at a finishing temperature of 800 to 1050° C. using a rolling mill group in which a continuous elongation rolling mill and a finish rolling mill are arranged closely. Thereafter, the produced steel pipes are quenched to a temperature not higher than the $Ar_3$ transformation point at a cooling rate of 80° C./minute or higher, the cooled steel pipes are reheated to 850 to 1000° C., and then are subjected to a process of quenching and tempering in succession.

This method for manufacturing seamless steel, in which the steps are carried out on a series of continuous lines, is characterized in that after the completion of finish rolling at a high temperature, the steel pipes are cooled to a temperature not higher than the $Ar_3$ transformation point (the cooling is stopped halfway), and thereafter are reheated, whereby reverse transformation from ferritic phase of body-centered cubic structure (BCC) to austenitic phase of face-centered cubic structure (FCC) is allowed to take place.

RELATED DOCUMENTS

Patent Document

[Patent Document 1] JP6-220536A
[Patent Document 2] JP2000-297344A
[Patent Document 3] JP8-311551A
[Patent Document 4] JP9-287028A

SUMMARY OF INVENTION

Problem to be Solved by the Invention

As described above, a large number of improved techniques of direct quenching or inline heat treatment (hereinafter, sometimes referred collectively to as "direct quenching or the like") in which reheating and quenching (or further subsequent tempering) are combined with the direct quenching process or the inline heat treatment method have been disclosed.

As disclosed in Patent Document 4, seamless steel pipes can be efficiently manufactured in a continuous line. However, if an attempt is made to carried out the invention of Patent Document 4, the problem is that large equipment investments are required, and at the same time, constraints are placed on the treatment time period and the like in each process step because of the continuous line.

On the other hand, the methods disclosed in Patent Documents 1 to 3 are not necessarily carried out on a continuous line. Therefore, by providing rapid cooling equipment for quenching on the delivery side of the finish rolling mill for pipes to be hot-rolled, or by providing complementary heating equipment before the first quenching on the delivery side of the finish rolling mill and providing rapid cooling equipment on the delivery side of the complementary heating equipment, the methods can be carried out by additionally using a heating furnace for quenching, the rapid cooling equipment for quenching, and a tempering furnace, all of which are offline. That means that the methods disclosed in Patent Documents 1 to 3 can be carried out easily by partially modifying or using existing equipment as compared with the method disclosed in Patent Document 4.

However, in the case where the steps of and subsequent to reheating for the second quenching (reheating and quenching) are carried out offline, the steel pipes must be conveyed to the entrance side of the offline quenching furnace after the completion of the first quenching (direct quenching or the like), and in some cases, they must be stored until reheating and quenching are started. In this case, there is a problem of shock cracking at the time of conveyance of steel pipes and storage cracking at the time of storage thereof. The shock cracking or the storage cracking is thought to be one kind of delayed fracture, and likely to occur in the as-quenched steel pipes.

By combining offline reheating and quenching and tempering with direct quenching or inline heat treatment, the increase in prior austenite grain size is suppressed, and therefore the toughness is improved. In the case of low-alloy steel, however, in order to achieve the quenching effect in the direct quenching, rapid cooling, usually water cooling, is needed. Therefore, in the low-alloy steel pipes in such a state, delayed fracture such as shock cracking is liable to occur, which is likely to cause a trouble in the conveying process to offline quenching equipment.

An objective of the present invention is to provide a method for manufacturing seamless steel pipes, wherein low-alloy seamless steel pipes once quenched by direct quenching or the like are offline heat-treated through reheating and quenching and tempering, which can suppress the occurrence of delayed fracture such as shock cracking and storage cracking without an adverse influence on the product performance.

Means to Solve the Problem

The present inventors earnestly conducted repeated studies and experiments on the means for suppressing shock cracking, and as a result obtained the following findings (a) to (f).

(a) Considering the operational experiences at factories, the hardness of steel of HRC 42 or lower at the stage before the reheating and quenching, preferably HRC 41 or lower, would cause subsequently no problem upon a usual shock at the conveyance stage. Further preferably, the hardness thereof is HRC 40 or lower.

(b) In order to provide the hardness of steel of HRC 42 or lower, preferably HRC 41 or lower, and further preferably HRC 40 or lower, at the stage before the reheating and quenching, the hardness of a seamless steel pipe should be HRC 42 or lower, preferably HRC 41 or lower, and further preferably HRC 40 or lower, at the time when steel pipes are produced at a high temperature and subjected to direct quenching and before they are conveyed from the line on which these processes have been carried out.

(c) It has been known widely that usually the hardness of as-quenched steel is high and is decreased by tempering. Therefore, by incorporating the tempering step after direct quenching and before the conveyance to the outside of line, the hardness of steel before conveyance may be decreased, so that delayed fracture such as shock cracking at the time of conveyance can be suppressed.

(d) However, it has been found that, in the case where the ordinary tempering is performed after direct quenching, offline reheating and quenching and tempering may foster a tendency for the prior austenite grain size to increase and the significance of offline quenching and tempering combined with direct quenching may be lost. In the case where a plurality of quenching steps are present in the process, the "prior austenite grain size" refers to one that is observed at the stage after the final quenching step has been completed.

(e) It has been revealed that the decrease in prior austenite grain size and the improvement in shock cracking resistance are both attained by performing heat treatment in a specific condition range after direct quenching.

This heat treatment depends on the heat treatment temperature. It is preferable that a PL value be adjusted in a predetermined range by using the following formula (1) as the Larson-Miller parameter, whereby the hardness of steel can be adjusted in a satisfying range:

$$PL=[T+273]\times[19.78+\log(t)] \quad (1)$$

wherein T is heat treatment temperature (° C.), t is heat treatment time period (hr), and log is common logarithm.

(f) The above is an explanation of a case where direct quenching is performed after hot finish rolling. However, in the case where, after hot finish rolling, steel pipes are heated in a complementary heating furnace and then are quenched, the same effect can also be achieved. And so can be achieved in the case of inline heat treatment method.

The present invention has been completed based on the above-described findings, and the gists thereof are methods for manufacturing seamless steel pipes described in the following items (1) to (7). Hereinafter, these gists are sometimes referred to as "present invention (1)" to "present invention (7)." Also, the present invention (1) to the present invention (7) are sometimes generally referred to as "the present invention."

(1) A method for manufacturing seamless steel pipes in which a billet consisting of, by mass percent, C: 0.15 to 0.35%, Si: 0.05 to 0.5%, Mn: 0.1 to 1.5%, Cr: 0.2 to 1.5%, Mo: 0.1 to 1.5%, Ti: 0.005 to 0.50%, and Al: 0.001 to 0.50%, the balance being Fe and impurities, the impurities having a composition of 0.1% or less of Ni, 0.04% or less of P, 0.01% or less of S, 0.01% or less of N, and 0.01% or less of O, is hot pierced and hot rolled, and further heat treatment is performed, wherein a hot rolled steel pipe is direct quenched from a temperature of not lower than the $Ar_3$ transformation point; subsequently, the steel pipe is subjected to heat treatment at a temperature of not lower than 450° C. and not higher than the $Ac_1$ transformation point in heat treatment equipment connected to a quenching apparatus for performing the direct quenching; and further the steel pipe subjected to the heat treatment is reheated, quenched from a temperature of not lower than the $Ac_3$ transformation point, and tempered at a temperature of not higher than the $Ac_1$ transformation point.

(2) The method for manufacturing seamless steel pipes described in the above item (1), wherein the heat treatment temperature in the heat treatment equipment connected to the quenching apparatus for performing the direct quenching is not lower than 450° C. and not higher than the $Ac_1$ transformation point, and a PL value defined by the following formula (1) is in the range of 14,000 to 18,600:

$$PL=(T+273)\times[19.78+\log(t)] \quad (1)$$

wherein T is heat treatment temperature (° C.), t is heat treatment time period (hr), and log is common logarithm.

(3) The method for manufacturing seamless steel pipes described in the above item (2), wherein the heat treatment temperature in the heat treatment equipment connected to the quenching apparatus for performing the direct quenching is higher than 500° C. and not higher than the $Ac_1$ transformation point, and a PL value defined by the following formula (1) is in the range of 14,000 to 18,600:

$$PL=(T+273)\times[19.78+\log(t)] \quad (1)$$

wherein T is heat treatment temperature (° C.), t is heat treatment time period (hr), and log is common logarithm.

(4) A method for manufacturing seamless steel pipes in which a billet consisting of, by mass percent, C: 0.15 to 0.35%, Si: 0.05 to 0.5%, Mn: 0.1 to 1.5%, Cr: 0.2 to 1.5%, Mo: 0.1 to 1.5%, Ti: 0.005 to 0.50%, and Al: 0.001 to 0.50%, the balance being Fe and impurities, the impurities having a composition of 0.1% or less of Ni, 0.04% or less of P, 0.01% or less of S, 0.01% or less of N, and 0.01% or less of O, is hot pierced and hot rolled, and further heat treatment is performed, wherein a hot rolled steel pipe is held at a temperature of not lower than the $Ar_3$ transformation point and not higher than 1000° C. and is inline quenched from a temperature of not lower than the $Ar_3$ transformation point; subsequently, the steel pipe is subjected to heat treatment at a temperature of not lower than 450° C. and not higher than the $Ac_1$ transformation point in heat treatment equipment connected to a quenching apparatus for performing the inline quenching; and further the steel pipe subjected to the heat treatment is reheated, quenched from a temperature of not lower than the $Ac_3$ transformation point, and tempered at a temperature of not higher than the $Ac_1$ transformation point.

(5) The method for manufacturing seamless steel pipes described in the above item (4), wherein the heat treatment temperature in the heat treatment equipment connected to the quenching apparatus for performing the inline quenching is not lower than 450° C. and not higher than the $Ac_1$ transformation point, and a PL value defined by the following formula (1) is in the range of 14,000 to 18,600:

$$PL=(T+273)\times[19.78+\log(t)] \quad (1)$$

wherein T is heat treatment temperature (° C.), t is heat treatment time period (hr), and log is common logarithm.

(6) The method for manufacturing seamless steel pipes described in the above item (5), wherein the heat treatment temperature in the heat treatment equipment connected to the quenching apparatus for performing the inline quenching is higher than 500° C. and not higher than the $Ac_1$ transformation point, and a PL value defined by the following formula (1) is in the range of 14,000 to 18,600:

$$PL=(T+273)\times[19.78+\log(t)] \quad (1)$$

wherein T is heat treatment temperature (° C.), t is heat treatment time period (hr), and log is common logarithm.

(7) The method for manufacturing seamless steel pipes described in any one of the above items (1) to (6), wherein the composition of the billet contains at least one kind of component selected from at least one of following element groups (I) to (III) in place of a part of Fe:

(I) B: 0.01% or less, (II) V: 0.5% or less, Nb: 0.4% or less, and (III) Ca: 0.005% or less, Mg: 0.005% or less, REM: 0.005% or less.

Effects of Invention

According to the present invention, in the manufacturing process of low-alloy seamless steel pipes in which the steel pipes once quenched by direct quenching or the like are offline heat treated through reheating, which can suppress the occurrence of delayed fracture such as shock cracking and storage cracking without an adverse influence on the product performance.

DESCRIPTION OF EMBODIMENTS

Figure 1:
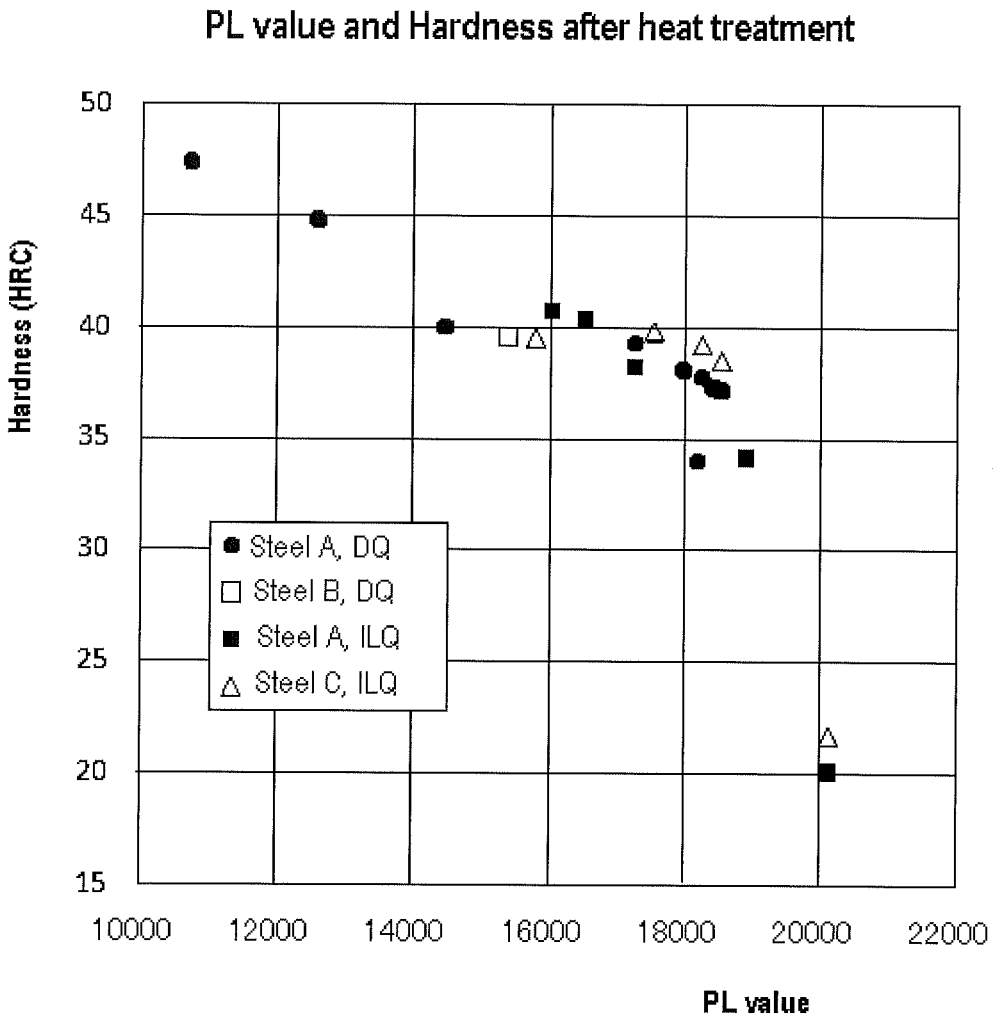
FIG. 1 is a graph showing the relationship between PL value and hardness after heat treatment.

A method for manufacturing low-alloy seamless steel pipes in accordance with the present invention will now be described in detail.

A. Chemical Composition of Low Alloy Steel

The method for manufacturing seamless steel pipes in accordance with the present invention is carried out through a process in which billets each having a specific low-alloy steal composition are hot pierced and hot rolled, and the rolled pipe is further subjected to heat treatment. First, the chemical composition of low alloy steel specified in the method for manufacturing low-alloy seamless steel pipes in accordance with the present invention is explained. Hereunder, the symbol "%" means "percent by mass."

C: 0.15 to 0.35%

C (carbon) is an element necessary for enhancing the hardenability of steel to improve the strength. However, if the C content is lower than 0.15%, the quenching effect is poor, and a sufficient strength cannot be obtained. On the other hand, if the C content exceeds 0.35%, the shock cracking resistance decreases remarkably, and in some cases, the effect of the present invention cannot be achieved. Also, quenching cracks may be formed in the steel pipe by the quenching operation only. Therefore, the C content is to be 0.15% to 0.35%. The preferable C content is 0.20 to 0.30%.

Si: 0.05 to 0.5%

Si (silicon) is an element that is necessary for deoxidation of steel and effective in enhancing the temper softening resistance to improve the SSC resistance. However, an excessive content thereof may have an effect of embrittling steel. For the purpose of deoxidation and improvement in SSC resistance, 0.05% or more of silicon needs to be contained, but the Si content exceeding 0.5% adversely affects the toughness and the SSC resistance. Therefore, the Si content is to be 0.05 to 0.5%. The preferable Si content is 0.10 to 0.35%.

Mn: 0.1 to 1.5%

Mn (manganese) is contained for deoxidation and desulfurization. However, if the Mn content is lower than 0.1%, the effect thereof is poor. On the other hand, the Mn content exceeding 1.5% decreases the toughness and the SSC resistance of steel. Therefore, the Mn content is to be 0.1 to 1.5%. The preferable Mn content is 0.20 to 0.70%.

Cr: 0.2 to 1.5%

Cr (chromium) is an element that assures the hardenability of steel, improves the strength thereof, and increases the SSC resistance thereof. However, the Cr content lower than 0.2% cannot achieve a satisfactory effect, and the Cr content exceeding 1.5% rather decreases the toughness and the SSC resistance. Therefore, the Cr content is to be 0.2 to 1.5%. The preferable Cr content is 0.3 to 1.0%.

Mo: 0.1 to 1.5%

Mo (molybdenum) enhances the hardenability of steel to assure high strength, and improves the temper softening resistance. As the result, molybdenum enables high-temperature tempering, and is effective in improving the SSC resistance. However, the Mo content lower than 0.1% reduces these effects, and on the other hand, the Mo content exceeding 1.5% saturates these effects and decreases the SSC resistance inversely by means of segregation. Therefore, the Mo content is to be 0.1 to 1.5%. The preferable Mo content is 0.3 to 0.8%.

Ti: 0.005 to 0.50%

Ti (titanium) precipitates as fine carbo-nitrides in the temperature rising process of reheating for offline quenching, and achieves an effect of preventing the increase in crystal grain size and the abnormal grain growth at the time of reheating and quenching. Also, titanium has an effect of fixing nitrogen, which is an impurity in steel. Therefore, when boron is added in the steel, titanium has an effect of allowing boron to exist in the steel in a solid solution state at the time of quenching to improve the hardenability of steel. However, the Ti content lower than 0.005% reduces these effects, and on the other hand, the Ti content exceeding 0.50% deteriorates the toughness of steel. Therefore, the Ti content is to be 0.005 to 0.50%. The preferable Ti content is 0.01 to 0.10%.

Al: 0.001 to 0.50%

Al (aluminum) is an element effective for deoxidation of steel. However, the Al content lower than 0.001% cannot achieve a desired effect, and the Al content exceeding 0.50% increases inclusions to deteriorate the toughness of steel. The coarsening of inclusions lowers the SSC resistance. Therefore, the Al content is to be 0.001 to 0.50%.

The chemical composition of the seamless steel pipe in accordance with the present invention consists of the balance of Fe and impurities in addition to the above-described components. The impurities as used herein refer to components that coexist due to various factors in the manufacturing process, including raw materials such as iron ore and scrap, when the seamless steel pipes are manufactured on the industrial base, and that are allowed to the extent that the present invention is not adversely affected.

In the present invention, the contents of Ni, P, S, N and O (oxygen) in the impurities must be restrained as described below.

Ni: 0.1% or less

Ni (nickel) lowers the SSC resistance of steel, and if the Ni content exceeds 0.1%, the SSC resistance lowers remarkably. Therefore, the content of Ni as an impurity element is to be 0.1% or less.

P: 0.04% or less

P (phosphorus) segregates at the grain boundary to decrease the toughness and the SSC resistance of steel, and the P content exceeding 0.04% remarkably decreases the toughness and the SSC resistance. Therefore, the upper limit of content of P as an impurity element is to be 0.04%. Preferably, the P content is 0.025% or less.

S: 0.01% or less

S (sulfur) produces coarse inclusions to decrease the toughness and the SSC resistance of steel. The S content exceeding 0.01% remarkably decreases the toughness and the SSC resistance. Therefore, the upper limit of content of S as an impurity element is to be 0.01%. Preferably, the S content is 0.005% or less.

N: 0.01% or less

N (nitrogen), if existing excessively, tends to produce coarse inclusions together with Al, Ti, Nb and the like to decrease the toughness and the SSC resistance of steel. The N content exceeding 0.01% remarkably decreases the toughness and the SSC resistance. Therefore, the upper limit of content of N as an impurity element is to be 0.01%. Also, the excessive existence of nitrogen hinders the hardenability improving effect of boron. Therefore, when boron is added in the steel, it is desirable to fix nitrogen by titanium so as not to hinder the effect of B addition.

O: 0.01% or less

O (oxygen) produces inclusions together with Al, Si and the like to decrease the toughness and the SSC resistance of steel by means of the coarsening of inclusions. The O content exceeding 0.01% remarkably decreases the toughness and the SSC resistance. Therefore, the upper limit of content of O as an impurity element is to be 0.01%.

As the chemical composition of the seamless steel pipe in accordance with the present invention, in addition to the above-described components, one or more kinds selected from among B, V, Nb, Ca, Mg and REM (rare earth elements) can further be contained as optional components, if necessary, in place of a part of Fe.

B: 0.01% or less

B (boron) can be contained if necessary. A minute content of boron increases the hardenability of steel and improves the SSC resistance thereof. However, the B content exceeding 0.01% decreases the toughness and the SSC resistance of steel. Therefore, the B content is to be 0.01% or less. Although the effect of boron can be achieved by the content of 0.0001% or higher, 0.0005% or higher of boron is preferably contained to stably achieve the effect of boron. When Ti content is insufficient and nitrogen is fixed insufficiently by titanium, solute nitrogen combines with boron to form BN, so that the effective B concentration decreases. The added amount of B must be determined considering the contents of Ti and N.

V: 0.5% or less

V (vanadium) can be contained if necessary. If being contained, vanadium precipitates as fine carbides (VC) at the time of tempering to raise the temper softening resistance and to enable high-temperature tempering. As the result, an effect of improving the SSC resistance is achieved. Especially since the addition of vanadium with niobium has an effect of giving larger sulfide stress cracking resistance to the steel, vanadium can be contained if necessary. However, the V content exceeding 0.5% deteriorates the toughness of steel. Therefore, the V content is to be 0.5% or less. The preferable V content is 0.2% or less. In order to stably achieve the V containing effect, 0.05% or more of V is preferably contained.

Nb: 0.4% or less

Nb (niobium) can be contained if necessary. If niobium is contained and complementary heating is performed after finish rolling, niobium precipitates as fine carbo-nitrides to prevent the increase in crystal grain size and the abnormal grain growth during reheating and quenching. In addition, solute niobium precipitates finely as carbo-nitrides during tempering after direct quenching, and achieves an effect of decreasing prior austenite gain size and improving the SSC resistance, so that niobium can be contained if necessary. However, the Nb content exceeding 0.4% deteriorates the toughness of steel. Therefore, the Nb content is to be 0.4% or less. The preferable Nb content is 0.1% or less. In order to stably achieve the Nb containing effect, the Nb content is preferably 0.005% or more. Further preferably, the Nb content is 0.01% or more.

Ca: 0.005% or less, Mg: 0.005% or less, REM: 0.005% or less

These elements can be contained if necessary. If being contained, any of these elements reacts with sulfur existing as an impurity in the steel to form sulfides, and has an effect of improving the shapes of inclusions and increasing the SSC resistance. Therefore, at least one kind of these elements can be contained if necessary. However, if any element is contained so as to exceed 0.005%, not only the toughness and the SSC resistance decrease but also many defects are produced on the surface of steel. Therefore, the content of any of these elements is to be 0.005% or less. The preferable content thereof is 0.003% or less. The upper limit of the sum in the case where two or more kinds of these elements are contained is 0.005% or less, preferably 0.003% or less. In order to stably achieve the containing effect of these elements, 0.0001% or more of any of these elements is preferably contained.

REM is the general term of seventeen elements in which Y and Sc are added to fifteen elements of lanthanoids, and one or more kinds of these elements can be contained. The content of REM means the total content of these elements.

B. Hot Piercing, Hot Rolling, and Heat Treatment

In the present invention, a billet consisting of the above-described low alloy steel is heated to a temperature range capable of performing piercing, and is subjected to hot piercing. The billet has only to have the above-described chemical composition, and it does not matter whether the billet is from an ingot material, a bloom continuous casting material, or a round CC (Round Billet Continuous Casting) material. The billet heating temperature before piercing is usually in the range of 1100 to 1300° C. The means for hot piercing is not necessarily restricted, and for example, a hollow shell can be obtained by Mannesmann piercing.

The obtained hollow shell is subjected to elongation rolling and finish rolling. The elongation is a step for producing a seamless steel pipe having a desired shape and size by elongating the hollow shell pierced by a piercer and by adjusting the size, and can be performed by using, for example, a mandrel mill or a plug mill The finish rolling can be performed by using a sizer or the like. The working ratio of the total of elongation and finish rolling is not necessarily restricted. Also, the desirable finish rolling temperature is in the range not higher than 1100° C. However, if the finish rolling temperature exceeds 1050° C., a tendency for the crystal grains to coarsen is developed. Therefore, the preferable rolling finishing temperature is 1050° C. or lower. If the rolling temperature is 900° C. or lower, the rolling becomes somewhat difficult to do because of the increase in deformation resistance.

In the present inventions (1) to (3), quenching is performed quickly after the completion of hot rolling. The quenching temperature must be not lower than the $Ar_3$ transformation point. The reason for this is that at temperatures of lower than the $Ar_3$ transformation point, the microstructure after direct quenching cannot be formed to a microstructure consisting mainly of martensite, and a predetermined strength cannot be obtained after the second quenching. As the quenching method, usual water quenching is economical. However, any quenching method in which martensitic transformation takes place can be used; for example, mist quenching may be used.

In the present inventions (4) to (6), after the completion of hot rolling, the hot rolled pipe is heated in a holding furnace at a temperature in the range of the $Ar_3$ transformation point to 1000° C. If the pipe is heated at a temperature exceeding 1000° C., the coarsening of austenite becomes remarkable, so that it becomes difficult to decrease prior austenite grain size even if reheating and quenching are performed in the subsequent process. In the methods of the present inventions (4) to (6), since the pipe is heated to a temperature in the above-described range just before inline quenching, if quenching is performed immediately after the heat treatment in the holding furnace, the quenching temperature of not lower than the $Ar_3$ transformation point can be secured sufficiently. The quenching method is the same as that in the present inventions (1) to (3).

In the present invention, after the above-described direct quenching or the quenching using the inline heat treatment method, the pipe is subjected to heat treatment at a temperature of not lower than 450° C. and not higher than the $Ac_1$ transformation point in a heat treatment equipment connected to the quenching apparatus for performing the above-described direct quenching or the like.

The manufacturing method of the present invention is characterized in that after the above-described direct quenching or the like, the pipe is subjected to heat treatment at a temperature of not higher than the $Ac_1$ transformation point in heat treatment equipment connected to the quenching apparatus for performing the above-described direct quenching or the like. This heat treatment step can reduce the hardness of steel, and suppress the occurrence of delayed fracture at the conveyance stage and in the storage state before the subsequent offline heat treatment (offline quenching). Therefore, for this purpose, it is necessary not only to perform the heat treatment at a temperature of not higher than the $Ac_1$ transformation point but also to perform this heat treatment in the heat treatment equipment connected to the quenching apparatus for performing the direct quenching or the like. Therefore, to perform the heat treatment offline at a temperature of not higher than the $Ac_1$ transformation point is quite meaningless because a need for conveying the quenched steel pipe for the heat treatment arises, which results in the occurrence of a problem of shock cracking at the conveyance stage.

The purpose of the heat treatment at a temperature of not higher than the $Ac_1$ transformation point is to control the hardness of steel to HRC 42 or lower, preferably HRC 41 or lower, and further preferably HRC 40 or lower. Thereby, the occurrence of delayed fracture, such as shock cracking and storage cracking, of the steel pipe is suppressed. The mechanism for suppressing the occurrence of delayed fracture is not necessarily definite. Since the toughness of steel pipe is also improved significantly by this heat treatment, the improvement in toughness may contribute to the suppression of shock cracking.

If the heat treatment temperature for the heat treatment is lower than 450° C., it is difficult to control the hardness of steel to HRC 42 or lower during a period of the ordinary heat treatment time, and the improvement in shock cracking resistance requires an extremely long period of heat treatment time. Therefore, in the heat treatment at a temperature lower than 450° C., a satisfactory improving effect cannot be achieved. On the other hand, if the heat treatment temperature for softening exceeds the $Ac_1$ transformation points, the steel pipe is heated to a two-phase zone of ferrite and austenite, so that the reverse transformation from the ferritic phase of body-centered cubic structure (BCC) to austenitic phase of face-centered cubic structure (FCC) cannot be accomplished completely in the next step. Therefore, to interpose the offline quenching step to completely accomplish this reverse transformation becomes meaningless. Preferably, the heat treatment temperature for the heat treatment is higher than 500° C. Hereinafter, the term "softening treatment" refers to heat treatment subsequent to direct quenching or the like and before reheating and quenching conducted so as to decrease hardness of steel pipe so that the said heat treatment can be distinguished easily from final tempering conducted after reheating and quenching.

Regarding the proper period of time for the softening treatment, since the softening treatment is performed continuously with the preceding step in the heating apparatus connected to the quenching apparatus in the step of direct quenching or the like, it is desirable to perform the heat treatment for a short period of time because of the features of this heat treatment. Although the softening treatment for a long period of time is not excluded in the viewpoint of preventing delayed fracture, the softening treatment for a short period of time requires only small-scale equipment. The period of softening treatment time is preferably 1 to 300 minutes, further preferably 2 to 60 minutes.

The softening effect of the softening treatment depends on the temperature of heat treatment. In the present invention, the following formula (1) can be used as the Larson-Miller parameter:

$$PL=[T+273]\times[19.78+\log(t)] \quad (1)$$

wherein T is heat (softening) treatment temperature (° C.), t is heat treatment time period (hr), and log is common logarithm.

In this case, it is preferable that the softening treatment be performed so that the PL value is in the range of 14,000 to 18,600. If the PL value is not lower than 14,000, the hardness of steel can be controlled to HRC 42 or lower, so that the shock cracking resistance can be improved further. If the PL value is not higher than 18,600, the γ grain size No. according to ASTM E-112-96 (the same shall apply hereinafter) after reheating and quenching can be made 8.5 or higher, so that the tendency for the SSC resistance to be improved becomes further pronounced.

Further preferably, the softening treatment is performed so that the PL value is in the range of 14,000 to 18,300. In this case, the γ grain size No. after reheating and quenching can be made 8.7 or higher.

Still further preferably, the softening treatment is performed so that the PL value is in the range of 17,000 to 18,000. In this case, the γ grain size No. after reheating and quenching can be made 8.8 or higher, and the hardness of steel can be controlled to HRC 40 or lower.

Thus, when the softening treatment is performed at a temperature of not higher than the $Ac_1$ transformation point, the more increasing tendency for the prior austenite grain size after reheating and quenching is recognized as compared with the case where this softening treatment is not performed. The detailed mechanism for this is not necessarily definite; however, it is assumed that carbo-nitrides of Ti and Nb precipitate finely with the rise in the heat (softening) treatment temperature and the prolongation of time period of the heat (softening) treatment. It is thought that since the carbo-nitrides partially agglomerate and coarsen in the process of reheating and quenching, the pinning effect becomes incomplete at the stage of soaking at a temperature of not lower than the $Ac_3$ transformation point of reheating and quenching, and the prior austenite grain size after final quenching increases slightly as compared with the case where the softening treatment is not performed after direct quenching. In the case where only the direct quenching is performed and the softening treatment is not performed, it is thought that since the steel pipe is subjected to soaking for quenching in a state in which few carbo-nitrides exist, carbo-nitrides precipitate finely at this stage, and the pinning effect is achieved sufficiently. Therefore, it is desirable to perform the softening treatment under a heating condition of minimum PL value necessary for controlling the hardness of steel to HRC 42 or lower, preferably HRC 41 or lower, and further preferably HRC 40 or lower.

It is desirable that the cooling after heat (softening) treatment be air cooling.

After the heat (softening) treatment, the cooled steel pipe is reheated and quenched offline, and is subsequently tempered. The reheating for offline quenching needs to be performed at a temperature of not lower than the $Ac_3$ transformation point. Since the quenching treatment needs to be performed from an austenitic state, a quenching temperature of not lower than the $Ar_3$ transformation point is secured. If the reheating temperature exceeds the $Ac_3$ transformation point+100° C., the austenite grains coarsen. Therefore, it is desirable to set the heating temperature at a temperature of not higher than the $Ac_3$ transformation point+100° C. As the quenching method, the water quenching method is generally used. However, any quenching method in which martensitic transformation takes place can be used; for example, mist quenching may be used.

The upper limit of the final tempering temperature is the $Ac_1$ transformation point that is the upper limit for preventing austenite from being precipitated. On the other hand, the lower limit of tempering temperature may be changed according to the steel pipe strength to be attained. When the strength is lowered, the tempering temperature is increased, and when the strength is raised, the tempering temperature is decreased.

It is desirable that the cooling after the final tempering be air cooling.

EXAMPLE 1

Steels A to C having the chemical compositions given in Table 1 were cast by a continuous casting machine to prepare billets each having a diameter of 310 mm. Each of the billets was pierced by a Mannesmann piercer after heated to 1250° C. Thereafter, by elongation rolling using a mandrel mill and diameter-reducing rolling using a reducer, the pipe was finished so as to have an outside diameter of 273.05 mm, a wall thickness of 19.05 mm, and a length of 12 m. The finishing temperature for hot rolling was 950° C.

TABLE 1

| Steel | Chemical composition (mass %, the balance being Fe and impurities) | | | | | | | | | | | | | | | | |
|---|---|---|---|---|---|---|---|---|---|---|---|---|---|---|---|---|---|
| | C | Si | Mn | P | S | Cr | Mo | Ti | Al | N | O | B | V | Nb | Ca | Mg | REM |
| A | 0.27 | 0.22 | 0.44 | 0.008 | 0.0040 | 1.04 | 0.45 | 0.027 | 0.041 | 0.0031 | 0.0008 | 0.0014 | — | 0.027 | 0.0012 | — | — |
| B | 0.27 | 0.26 | 0.42 | 0.010 | 0.0010 | 1.01 | 0.67 | 0.012 | 0.036 | 0.0036 | 0.0007 | 0.0011 | 0.09 | 0.026 | — | — | — |
| C | 0.27 | 0.29 | 0.45 | 0.006 | 0.0012 | 0.51 | 0.69 | 0.017 | 0.039 | 0.0044 | 0.0009 | 0.0010 | 0.09 | 0.011 | 0.0004 | 0.0002 | — |

The hot rolled steel pipe was subjected to either of (a) direct quenching performed by water quenching and (b) inline heat treatment in which concurrent heating of 950° C.×10 min was performed immediately after the completion of hot rolling, and quenching was performed by water cooling. The conditions of heat (softening) treatment are as given in Table 2. In Table 2, DQ indicates that the direct quenching of the item (a) above was performed, and ILQ indicates that the inline heat treatment of the item (b) above was performed.

ture of not lower than 680° C. and not higher than the $Ac_1$ transformation point with the soaking time period being 30 to 60 minutes so that the YS of the steels would be controlled to 90 ksi grade for steels A and B, and 110 ksi grade for steel C.

As the examination items, hardness measurement and Charpy test were performed at the stage at which the softening treatment was performed after direct quenching or the like (for the comparative steel pipe that was not subjected to softening treatment after direct quenching, at the stage at

TABLE 2

| Test No. | Steel | Process after hot rolling (Note 1) | Heat (Softening) treatment: Heating Temperature | Heat (Softening) treatment: Soaking time period | Property before reheating and quenching: Absorbed energy (J) | Property before reheating and quenching: Percent ductile fracture (%) | Property before reheating and quenching: Hardness (HRC) | Condition of reheating and quenching | γ grain size after reheating and quenching | PL value | Remark (Note 3) |
|---|---|---|---|---|---|---|---|---|---|---|---|
| 1 | A | DQ | 700° C. | 5 min. | 72.3 | 73.7 | 34 | 920° C. × 20 min heated, then water cooled | 8.7 | 18196 | The invention |
| 2 | A | DQ | 650° C. | 30 min. | 41.7 | 53 | 38.1 | | 8.8 | 17979 | |
| 3 | A | DQ | 650° C. | 60 min. | 40.3 | 55.3 | 37.8 | | 8.8 | 18257 | |
| 4 | A | DQ | 650° C. | 90 min. | 50.7 | 61.7 | 37.3 | | 8.8 | 18419 | |
| 5 | A | DQ | 650° C. | 120 min. | 47.3 | 59 | 37.2 | | 8.8 | 18535 | |
| 6 | A | DQ | 600° C. | 5 min. | 48 | 55.3 | 39.3 | | 9 | 17261 | |
| 7 | A | DQ | 500° C. | 5 min. | 36.3 | 49.7 | 40 | | 9.1 | 14456 | |
| 8 | A | DQ | 400° C. | 5 min. | 25 | 34 | 44.8 | | *** | 12586 | Comparative |
| 9 | A | DQ | 300° C. | 5 min. | 30.3 | 35.7 | 47.4 | | *** | 10716 | |
| 10 | B | DQ | 550° C. | 5 min | *** | *** | 39.6 | | 9.1 | 15391 | The invention |
| 11 | A | AR | — | — | *** | *** | *** | | 8.4 | | Conventional I |
| 12 | A | DQ | — | — | 28.7 | 25.7 | 47.9 | | 9.3 | | Conventional II |
| 13 | A | DQ | — | — | ibid. to No. 12 | | | — | 6.1 (Note 2) | | Reference |
| 14 | A | ILQ | 710° C. | 300 min. | 88.3 | 70.3 | 20.1 | 920° C. × 20 min heated, then water cooled | 8.3 | 20131 | The invention |
| 15 | A | ILQ | 650° C. | 5 min. | *** | *** | 38.2 | | 8.9 | 17261 | |
| 16 | A | ILQ | 650° C. | 300 min. | 74.0 | 85.0 | 34.2 | | 8.4 | 18902 | |
| 17 | A | ILQ | 550° C. | 30 min. | 41.7 | 56.3 | 40.7 | | 9.1 | 16031 | |
| 18 | A | ILQ | 550° C. | 120 min. | 45.7 | 62.7 | 40.3 | | 9.0 | 16527 | |
| 19 | A | AR | — | — | *** | *** | *** | 900° C. × 69 min heated, then water cooled | 8.2 | | Conventional I |
| 20 | A | ILQ | — | — | *** | *** | *** | | 9.1 | | Conventional II |
| 21 | A | ILQ | — | — | 28.7 | 38.6 | 49.8 | — | 5.6 (Note 2) | | Reference |
| 22 | C | ILQ | 710° C. | 300 min. | 128.7 | 84 | 21.7 | 920° C. × 20 min heated, then water cooled | 8.3 | 20131 | The invention |
| 23 | C | ILQ | 650° C. | 10 min. | 46.3 | 52 | 39.8 | | 8.8 | 17539 | |
| 24 | C | ILQ | 650° C. | 60 min | 69.3 | 76.7 | 39.2 | | 8.7 | 18257 | |
| 25 | C | ILQ | 650° C. | 120 min. | 54 | 63.3 | 38.5 | | 8.6 | 18535 | |
| 26 | C | ILQ | 550° C. | 15 min. | *** | *** | 39.5 | | 9.0 | 15783 | |
| 27 | C | ILQ | — | — | *** | *** | *** | | 9.0 | — | Conventional II |
| 28 | C | AR | — | — | *** | *** | *** | ibid. to No. 19 | 8.2 | — | Conventional I |
| 29 | C | ILQ | — | — | 42.3 | 52.3 | 49.3 | — | 5.8 (Note 2) | — | Reference |

*** shows that there is no mesurement.

(Note 1): DQ: Direct quenching, ILQ: Inline heat treatment (After hot rolling, coplementarily heating and quenching), AR: As rolled (natural cooled after hot (Note 2): γ grain size after DO or ILQ is shown.

(Note 3): Conventional I: AR, then reheating and quenching, Conventional II: DO or ILQ, then reheating and quenching.

To simulate the effect of the heat (softening) treatment after direct quenching or after quenching using inline heat treatment, the steel pipe having been quenched by water cooling was cut to parts, and was subjected to heat treatment under various conditions in an experimental furnace. Further, quenching and tempering simulating offline quenching and tempering were performed in the experimental furnace. The heating condition for quenching was 920° C., the soaking time period was 20 minutes, and the quenching was water quenching The final tempering was performed at a temperawhich only the direct quenching was performed). That is, a specimen was sampled from the steel pipes that were subjected to only the direct quenching and were subjected to the softening treatment after the direct quenching or the like.

For the hardness measurement, C scale hardness (HRC) was measured at three points of each of a portion near the inner surface, a portion in the center of the wall thickness, and a portion near the outer surface by using a Rockwell hardness tester, and the mean value of nine points was calculated.

For the Charpy test, a V-notch specimen having a width of 10 mm that was cut out in the L direction (the direction in which the lengthwise direction is parallel with the rolling direction) in conformity to ASTM E-23 was prepared.

The test was conducted at room temperature, and the percent ductile fracture and the absorbed energy were evaluated.

The remaining portion of the steel pipe from which the specimen for the above-described examination had been sampled was further subjected to the above-described reheating and quenching and tempering. On the steel pipe in this final state, the prior austenite grain size and the SSC resistance were examined.

The prior austenite grain size was examined in conformity to ASTM E-112-96 by embedding a specimen having a cross section perpendicular to the rolling direction in a resin and by causing the grain boundary to appear by corroding the specimen using picric acid saturated aqueous solution (Bechet-Beaujard method).

These examination results are also given in Table 2. In Table 2, test No. 12 is a conventional example in which steel A was not subjected to the heat (softening) treatment after the direct quenching or the like, and was subjected to the reheating and quenching and the tempering (in Table 2, indicated as conventional method II). Test No. 13 is an example taken to show the prior austenite grain size in the state of direct quenching only, showing the prior austenite grain size obtained in the process in which only the tempering was performed after direct quenching (in Table 2, indicated as reference example). Test No. 11 is a case in which steel A was hot pierced and rolled to produce a pipe in the same way, the pipe was allowed to cool to room temperature, and then was water quenched by being soaked at 920° C. for 20 minutes, and the quenched pipe was tempered at 695° C. for 60 minutes (that is, a case of "reheating and quenching and tempering" of prior art, in Table 2, indicated as conventional method I), in which the prior austenite grain size was measured after quench heating.

Test No. 20 (steel A) and No. 27 (steel C) are as for the conventional in which after inline heat treatment, the pipe was reheated and quenched and tempered without being subjected to heat (softening) treatment (indicated as conventional method II in Table 2). Test No. 21 (steel A) and No. 29 (steel C) are as for reference to show the prior austenite grain size in the state of quenching only after inline heat treatment, showing the prior austenite grain size obtained in the process in which only the tempering was performed after quenching immediately after inline heat treatment (indicated as reference example in Table 2).

Test No. 19 (steel A) and No. 28 (steel C) are cases in which a billet was hot pierced and rolled to produce a pipe, the pipe was allowed to cool to room temperature, and then was water quenched by being soaked at 900° C. for 69 minutes in an offline heat treatment furnace of industrial equipment, and the quenched pipe was tempered at 695° C. for 60 minutes (that is, a case of "reheating and quenching and tempering" of prior art, indicated as conventional method I in Table 2), in which the prior austenite grain size was measured after reheating and quenching.

As is apparent from Table 2, for example, the hardness of about HRC 48 of test No. 12 of direct quenching is decreased approximately to 40 by the heat treatment of 500° C.×5 min as softening after direct quenching or the like as shown in test No. 7. Therefore, it is assumed that if heating is performed for a longer period of time at 500° C. or a temperature exceeding 500° C., a hardness of not higher than HRC 41 is provided.

FIG. 1 is a graph showing the relationship between PL value and hardness, which is obtained based on the test results of Table 2. It is thought that if the PL value is not lower than 14,000, a hardness not higher than HRC 42 can be secured.

Regarding the prior austenite grain size after reheating and quenching, in the case where reheating and quenching and tempering are performed without the softening treatment after direct quenching, for example, in test No. 12, the prior austenite grain size No. is 9.3. In this case, the prior austenite grain size decreases as compared with grain size No. 8.4 in the case where a billet is hot pierced and rolled to produce a pipe, and then the pipe is cooled without direct quenching, and reheated and quenched and tempered (test No. 11, conventional method I). However, there is recognized a tendency for the prior austenite grain size No. after the final quenching to decrease with the rise in temperature of the heat (softening) treatment or the prolongation of heat treatment time period.

Figure 2:
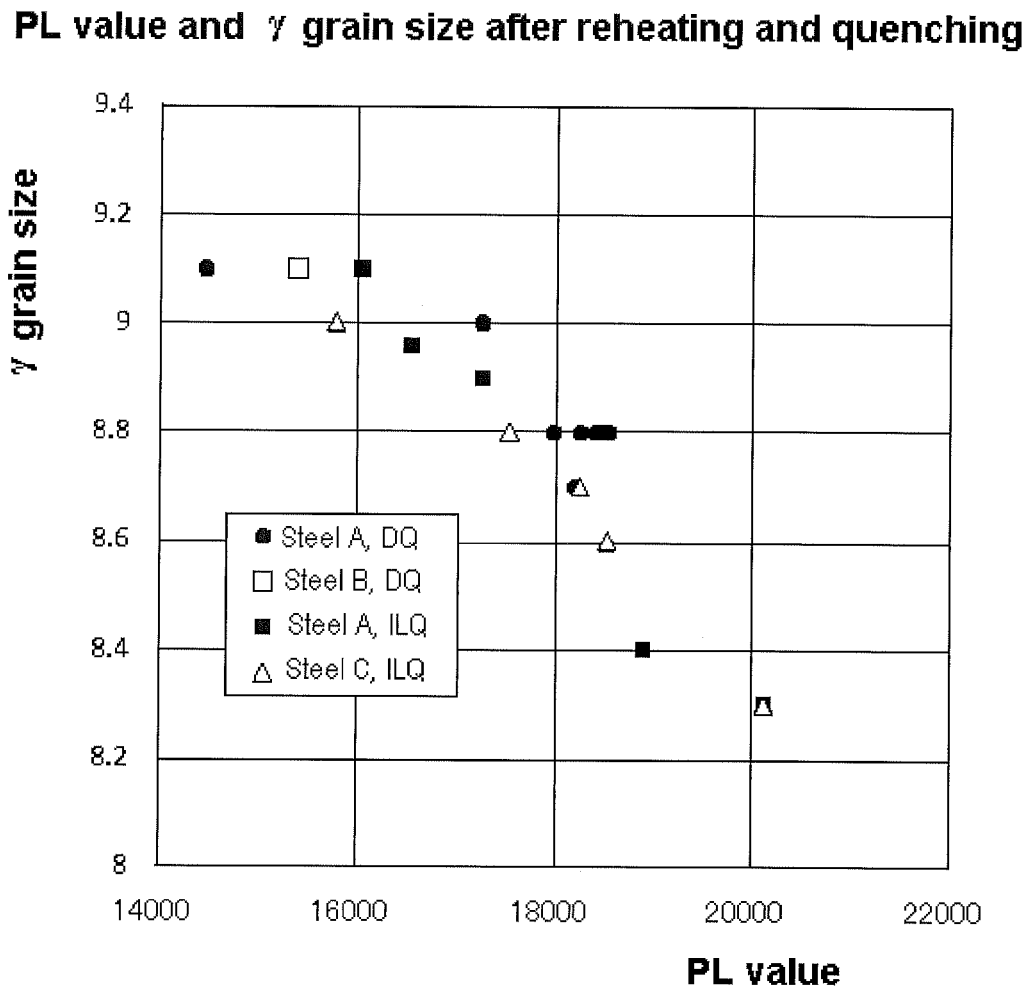
FIG. 2 is a graph showing the relationship between PL value and austenite (γ) grain size after reheating and quenching.

The same tendency is recognized in the case where quenching is performed after inline heat treatment. FIG. 2 is a graph showing the relationship between PL value and austenite (γ) grain size after reheating and quenching (before the final tempering), which is obtained based on the test results of Table 2. It is apparent that if the PL value exceeds 19,000, the grain size No. decreases remarkably.

Therefore, in order to secure superiority in performance over conventional method II (reheating and quenching method) such as test Nos. 11, 19 and 28, the grain size No. should be 8.5 or larger, preferably 8.7 or larger. Therefore, the PL value should be 18,600 or lower, preferably 18,300 or lower.

To verify the SSC resistance, a constant load test was conducted for test Nos. 1, 7 and 15 using the round-bar tensile test specimen and test conditions specified in NACE TM0177 Method A. The test specimen was sampled from a steel material subjected to the final tempering so that the lengthwise direction thereof was the rolling direction (L direction), and the dimensions of the parallel part of the test specimen were 6.35 m in length and 25.4 mm in outside diameter. In the test, as the test solution, an aqueous solution of 0.5% acetic acid+5% salt (Sodium Chloride) was used, and a stress of 90% of nominal minimum yield stress (a stress of 85.5 ksi because in this test, adjustment was made so that the nominal yield stress of 95 ksi could be obtained for the tested steel pipe) was applied while hydrogen sulfide gas of 0.1 MPa was supplied to this solution. The test results are given in Table 3.

TABLE 3

| | Heat (Softening) treatment | | Estimation | | | |
|---|---|---|---|---|---|---|
| Test No. | Heating temparature (° C.) | Soaking time (min) | YS [MPa] | TS [MPa] | Hardness (HRC) | Ruptuer time [hr] |
| 1 | 700 | 5 | 753.5 | 845 | 24.8 | ○ |
| 7 | 500 | 5 | 753 | 844.5 | 25.2 | ○ |
| 15 | 650 | 5 | 762.6 | 839.5 | 24.6 | ○ |

○: No fracture after immersed for 720 hr.

In all of the test numbers, it was verified that no rupture occurs in the 720-hr constant load test, and there arises no problem with SSC resistance.

EXAMPLE 2

Steels D to H whose chemical compositions are shown in Table 4 were cast by a continuous casting machine, and prepared billets each having a diameter of 310 mm. Each of the billets was hot pierced by a Mannesmann piercer after heated to 1250° C. Hot rolling was finished at a finish rolling temperature of 950° C., so that the pipe was finished so as to have an outside diameter of 273.05 mm, a wall thickness of 19.05 mm, and a length of 12 m. For steel D, after the completion of finish rolling, direct quenching was performed by water cooling. For steels E to H, after the completion of finish rolling, inline heat treatment involving quenching by water cooling was performed after concurrent heating of 950° C.×10 min, and further heat (softening) treatment was performed by a heat treatment apparatus connected to quenching apparatus of the inline heat treatment step. For comparison, a kind of steel (steel F) was natural cooled after the completion of finish rolling.

TABLE 4

| | Chemical composition (mass %, the balance being Fe and impurities) | | | | | | | | | | | | | | | | |
|---|---|---|---|---|---|---|---|---|---|---|---|---|---|---|---|---|---|
| Steel | C | Si | Mn | P | S | Cr | Mo | Ti | Al | N | O | B | V | Nb | Ca | Mg | REM |
| D | 0.27 | 0.27 | 0.42 | 0.008 | 0.0055 | 1.03 | 0.45 | 0.027 | 0.044 | 0.0052 | 0.0029 | 0.0013 | — | 0.029 | 0.0021 | — | — |
| E | 0.27 | 0.27 | 0.47 | 0.010 | 0.0050 | 1.03 | 0.47 | 0.027 | 0.037 | 0.0066 | 0.0008 | 0.0012 | — | 0.028 | — | — | — |
| F | 0.27 | 0.25 | 0.51 | 0.008 | 0.0038 | 1.04 | 0.47 | 0.026 | 0.018 | 0.0010 | 0.0008 | 0.0011 | — | 0.029 | — | — | — |
| G | 0.26 | 0.29 | 0.46 | 0.007 | 0.0025 | 1.04 | 0.70 | 0.019 | 0.032 | 0.0048 | 0.0011 | 0.0011 | — | 0.028 | 0.0012 | — | 0.0003 |
| H | 0.26 | 0.28 | 0.46 | 0.011 | 0.0005 | 1.03 | 0.68 | 0.013 | 0.026 | 0.0044 | 0.0010 | 0.0011 | 0.09 | 0.013 | 0.0011 | 0.0003 | — |

Subsequently, all of these test materials were reheated in an offline heat treatment furnace, and quenched (water cooled), and were further tempered. The tempering was performed in the temperature range of 680° C. to the $Ac_1$ transformation point so that the YS of the steels would be controlled to 95 ksi grade for steels D to G, and 110 ksi grade for steel H. For all of the test materials, at the stage before tempering, the austenite grain size of steel was measured by the same method as that in example 1.

From the steel pipe manufactured by the above-described process, a round-bar tensile test specimen having a parallel part diameter of 6.36 mm and a gauge length of 25.4 mm was sampled along the rolling direction. A tensile test was conducted at the normal temperature, and the SSC resistance was evaluated by the DCB (Double Cantilever Beam) test. A DCB specimen having a thickness of 10 mm, a width of 25 mm, and a length of 100 mm was sampled from each of the test materials, and the DCB test was conducted in conformity to NACE (National Association of Corrosion Engineers) TM0177-2005 method D. As the test bath, an aqueous solution of 5 wt % salt+0.5 wt % acetic acid at the normal temperature (24° C.) in which hydrogen sulfide gas of 1 atm was saturated was used. The specimen was dipped in this test bath for 336 hours, and the stress intensity factor $K_{ISSC}$ (ksi·in$^{0.5}$) was determined by the method specified in the aforementioned method D. The test results are given in Table 5 together with the heat treatment conditions.

TABLE 5

| Test No. | Steel | Process after hot rolling (Note 1) | Condition of complementary heating | Condtion of heat (softening) treatment | Condition of reheating and quenching | PL value | YS (ksi) | γ grain size after reheating and quenching | KISSC (ksi · in$^{1/2}$) |
|---|---|---|---|---|---|---|---|---|---|
| 51 | D | DQ | — | — | 920° C., 45.8 min | — | 107.5 | 9.1 | 32.4 |
| 52 | E | ILQ | 950° C., 15.5 min | 560° C., 75.6 min | 900° C., 69 min | 16560 | 107.6 | 8.7 | 31.1 |
| 53 | E | ILQ | | | | 16560 | 107.6 | 8.7 | 30.7 |
| 54 | F | AR | — | — | | — | 106.3 | 8.3 | 28.8 |
| 55 | F | AR | — | — | | — | 106.7 | 7.6 | 28.1 |
| 56 | G | ILQ | 950° C., 16.4 min | 560° C., 82.5 min | | 16592 | 100.1 | 8.8 | 38.6 |
| 57 | G | ILQ | | | | 16592 | 100.1 | 8.8 | 35.6 |
| 58 | G | ILQ | | | | 16592 | 100.1 | 8.8 | 33.7 |
| 59 | G | ILQ | | | | 16592 | 100.1 | 8.8 | 31.8 |
| 60 | H | ILQ | 950° C., 16.2 min | 560° C., 67.5 min | 920° C., 68 min | 16519 | 113.3 | 9 | 25.5 |
| 61 | H | ILQ | | | | 16519 | 113.3 | 9 | 24.8 |

(Note 1): DQ: Direct quenching, ILQ: Inline heat treatment (After hot rolling, soaked and quenching, AR: As cooled (natural cooled) after hot roll.

Test Nos. 52 and 53 and test Nos. 56 to 61 are the present invention in which after inline heat treatment, heat (softening) treatment was performed in heat treatment equipment connected to the quenching apparatus. The γ grain size No. after reheating and quenching of present invention examples was 8.7 or larger. $K_{ISSC}$ was 30.7 ksi·in$^{1/2}$ or higher for the test material whose YS was lower than 110 ksi and was 24.8 ksi·in$^{1/2}$ or higher for the test material whose YS was not lower than 110 ksi. Generally, the SSC resistance is required that $K_{ISSC}$ be 30 or higher for YS 95 ksi grade, and be 24 or higher for YS 110 ksi grade. According to the present invention, it is apparent that necessary SSC resistance is secured.

Test No. 51 is the comparative in which quenching and tempering were performed offline after direct quenching, in which the SSC resistance is excellent unless there is no problem of delayed fracture. Test Nos. 54 and 55 are some of the conventional in which after the completion of hot rolling, the as-rolled pipes were reheated and quenched. It is apparent that the SSC resistance of the present invention is excellent as compared with that of the conventional.

INDUSTRIAL APPLICABILITY

According to the present invention, in the manufacturing process of low-alloy seamless steel pipes in which the steel pipes, wherein low-alloy seamless steel pipes once quenched by direct quenching or the like are offline heat-treated through reheating and quenching and tempering, which can suppress the occurrence of delayed fracture such as shock cracking and storage cracking without an adverse influence on the product performance.

The invention claimed is:

1. A method for manufacturing seamless steel pipes in which a billet consisting of, by mass percent, C: 0.15 to 0.35%, Si: 0.05 to 0.5%, Mn: 0.1 to 1.5%, Cr: 0.2 to 1.5%, Mo: 0.1 to 1.5%, Ti: 0.005 to 0.50%, and Al: 0.001 to 0.50%, the balance being Fe and impurities, the impurities having a composition of 0.1% or less of Ni, 0.04% or less of P, 0.01% or less of S, 0.01% or less of N, and 0.01% or less of 0, is hot pierced and hot rolled, and further heat treatment is performed, wherein (1) a hot rolled steel pipe is direct quenched from a temperature of not lower than the $Ar_3$ transformation point; or (2) a hot rolled steel pipe is held at a temperature of not lower the $Ar_3$ transformation point and not higher than 1000° C. and is inline quenched from a temperature of not lower than the $Ar_3$ transformation point; subsequently, the steel pipe is controlled to HRC 42 or lower in hardness by means of a heat treatment in a heat treatment equipment connected to a quenching apparatus for performing the direct quenching or the inline quenching, wherein heat treatment temperature T (° C.) and heat treatment time period t (hr) satisfy that a PL value defined by the formula (1) below is in the range of 14,000 to 18,600 in condition of 450° C.<T≤the $Ac_1$ transformation point, $$PL=(T+273)\times[19.78+\log(t)] \quad (1)$$

wherein T is heat treatment temperature (° C.), t is heat treatment time period (hr), and log is common logarithm; and further the steel pipe is reheated, quenched from a temperature of not lower than the $Ac_3$ transformation point, and tempered at a temperature of not higher than the $Ac_1$ transformation point.

2. The method for manufacturing seamless steel pipes according to claim 1, wherein the heat treatment temperature T (° C.) and heat treatment time period t (hr) satisfy that a PL value is in the range of 14,000 to 18,600 in condition of 500° C.<T≤the $Ac_1$ transformation point.

* * * * *

UNITED STATES PATENT AND TRADEMARK OFFICE

CERTIFICATE OF CORRECTION

PATENT NO. : 8,696,834 B2
APPLICATION NO. : 13/236702
DATED : April 15, 2014
INVENTOR(S) : Kondo et al.

It is certified that error appears in the above-identified patent and that said Letters Patent is hereby corrected as shown below:

In The Claims

Column 19, line 20:
"of 0 is hot pierced and hot rolled, and"
should read
"of O is hot pierced and hot rolled, and"

Column 19, line 25:
"the $Ar_3$ transformation point and not higher than 1000°"
should read
"than the $Ar_3$ transformation point and not higher than 1000°"

Signed and Sealed this
Thirteenth Day of January, 2015

Michelle K. Lee

Michelle K. Lee
*Deputy Director of the United States Patent and Trademark Office*